US007620191B2

(12) United States Patent
Tanabe et al.

(10) Patent No.: US 7,620,191 B2
(45) Date of Patent: Nov. 17, 2009

(54) CONDENSER MICROPHONE AND METHOD FOR MANUFACTURING THE SAME

(75) Inventors: Haruhisa Tanabe, Fujiyoshida (JP); Atsushi Kanemaru, Fujiyoshida (JP)

(73) Assignee: Citizen Electronics Co., Ltd., Fujiyoshida-shi, Yamanashi-ken (JP)

( * ) Notice: Subject to any disclaimer, the term of this patent is extended or adjusted under 35 U.S.C. 154(b) by 735 days.

(21) Appl. No.: 11/304,514

(22) Filed: Dec. 14, 2005

(65) Prior Publication Data

US 2006/0140423 A1 Jun. 29, 2006

(30) Foreign Application Priority Data

Dec. 15, 2004 (JP) ..... 2004-362673

(51) Int. Cl.
*H04R 25/00* (2006.01)

(52) U.S. Cl. ..... 381/174; 381/191

(58) Field of Classification Search ..... 381/355, 381/357, 369, 174, 175, 191, 398; 367/140, 367/170, 181; 29/25.41, 594
See application file for complete search history.

(56) References Cited

U.S. PATENT DOCUMENTS 3,963,881 A * 6/1976 Fraim et al. ..... 381/357
4,117,275 A * 9/1978 Miyanaga et al. ..... 381/174
4,281,222 A * 7/1981 Nakagawa et al. ..... 381/357
4,456,796 A * 6/1984 Nakagawa et al. ..... 381/191
5,272,758 A * 12/1993 Isogami et al. ..... 381/191

FOREIGN PATENT DOCUMENTS

JP H11-088992 3/1999
JP 2003-230195 8/2003

* cited by examiner

*Primary Examiner*—Huyen D Le
(74) *Attorney, Agent, or Firm*—Brinks Hofer Gilson & Lione

(57) ABSTRACT

A condenser microphone includes a housing and a microphone unit arranged within the housing. The microphone unit includes an annular retainer oriented in confronting relation to the front end wall of the housing, a movable diaphragm connected to the annular retainer, an annular spacer connected to one side of the movable diaphragm opposite the annular retainer, a substrate including a back electrode oriented in confronting relation to the movable diaphragm and having an electret thereon, and a printed circuit board having electronic components. The back electrode is operatively associated with the movable diaphragm to constitute a condenser. The condenser has a variable electric capacitance. The electronic components of the printed circuit board develop an electric signal in response to a change in the electrical capacitance between the movable diaphragm and the back electrode. A conductive adhesive is employed to sealingly hold the annular retainer against the front end wall of the housing.

6 Claims, 6 Drawing Sheets

CONDENSER MICROPHONE AND METHOD FOR MANUFACTURING THE SAME

This application claims priority under 35 U.S.C. § 119 to Japanese Patent Application No. 2004-362673 filed Dec. 15, 2004, the entire content of which is hereby incorporated by reference.

FIELD OF THE INVENTION

The present invention relates to a condenser microphone with improved waterproof capability and improved electric shielding effect and a method for manufacturing the same.

BACKGROUND OF THE INVENTION

An electret condenser microphone has a wide variety of applications owing to its structural simplicity, compactness and reasonable fabrication cost. The electret condenser microphone has recently been used in a cellular phone and other portable audio devices. There is thus an increasing need to further reduce the size of and enhance the performance and reliability of the electret condenser microphone. To meet this need, Japanese patent application publication No. 11-088992 proposes a condenser microphone wherein a semiconductor chip, a conductive layer or a back electrode, an electret, a spacer and a movable diaphragm are stacked in that order.

Referring specifically to FIG. 5, there is shown, in section, a condenser microphone generally designated as at 30. The condenser microphone 30 includes a semiconductor chip 31 with a FET as an impedance converter and an amplifier. A conductive layer 32 is vacuum deposited on the semiconductor chip 31. A dielectric layer or electret 33 is formed on the conductive layer 32. A spacer 34 is printed on the outer peripheral edge of the electret 33. A movable diaphragm 35 is attached to the spacer 34 and cooperates with the electret 33 to form a working gap or air chamber 36.

The semiconductor chip 31, the conductive layer 32, the electret 33, the spacer 34 and the movable diaphragm 35 collectively form a microphone unit 37. A housing 38 is made of ceramic and encloses the microphone unit 37. The housing 38 has a front end wall, a rear end wall and a peripheral wall extending between the front and rear end walls. A plurality of sound inlet ports 38*a* are formed in the front end wall of the housing 38. A fabric or cloth 39 is attached to the front end wall of the housing. The semiconductor chip 31 includes two terminals or leads 31*a*, 31*b*. The two leads 31*a*, 31*b* extend through the rear end wall of the housing 38 and are soldered thereto.

As described above, the semiconductor chip 31 and all the other main components are integrated into a small unit. This arrangement enables the condenser microphone 30 to be economically manufactured on a mass production basis.

Japanese patent application publication No. 2003-230195 discloses a condenser microphone wherein a housing serves as an electric shield to inhibit entry of electric noise into the housing within which a microphone unit is contained. Referring specifically to FIG. 6, there is shown, in section, a condenser microphone 40 which includes a metallic housing 41. The housing 41 has a front end wall 43 and a cylindrical side wall 44 extending from the front end wall 43. A plurality of sound inlet ports 42 extend through the front end wall 43 of the housing 41. The front end wall 43 of the housing 41 acts as a fixed electrode. The housing 41 is formed on its inner surface with an electret 45. Disposed within the housing 41 are an annular electrically insulative spacer 46, an electrically conductive movable diaphragm 48 supported on a support ring 47 and acting as a movable electrode, and a cylindrical conductive ring 49.

The housing 41 has an open rear end in which a printed circuit board 51 is arranged. A plurality of electronic components 50 such as a FET are surface mounted onto the inner surface of the printed circuit board 51. The printed circuit board 51 is provided on its outer periphery with a conductive layer or ground section 51*a*. The lower end of the side wall 44 is radially inwardly curved to form a bent end 44*a*. The bent end 44*a* makes contact with the ground section 51*a* to provide an electrical connection between the housing 41 and the ground section 51*a*. This arrangement electrically isolates the interior of the housing 41 from the outside of the housing 41. A filter 52 is attached to the outer surface of the front end wall 43 of the housing 41 and is made of a non-woven fabric, a cloth and other materials. The front end wall 43 of the housing 41 and the movable diaphragm 48 collectively constitute a condenser. With this arrangement, a change in electrical capacitance between the front end wall 43 of the housing 41 and the movable diaphragm 48 occurs when the diaphragm 48 is vibrated or deflected in response to an incident sound pressure wave through the sound inlet ports 42. Such a capacitive change is converted to an impedance by means of the electronic components 50 and then output as an electrical signal from a terminal 51*b*. The terminal 51*b* is formed on the outer surface of the printed circuit board 51.

Again, the ground section 51*a* and the bent end 44*a* of the metallic housing 41 are connected to electrically isolate the interior of the microphone unit. The condenser microphone 40 is thus capable of preventing entry of electric noise into the interior of the microphone and providing a relatively low signal to noise ratio.

A problem with the condenser microphone 30 shown in Japanese patent application publication No. 11-088992 is that water may enter the interior of the housing 38 if clearances are left between the side wall and the rear end wall of the housing and between the through holes in the rear end wall of the housing and the corresponding leads 31*a*, 31*b*, as shown by the imaginary arrows in FIG. 5. The water, when entered, can oxidize the surface of the movable diaphragm 35. Obviously, such oxidization adversely affects the sensitivity and the frequency characteristics of the movable diaphragm 35. This problem becomes more serious particularly in case that the movable diaphragm is formed with a plurality of perforations (not shown). In such a case, the water may even flow over the rear side of the movable diaphragm 35. This further deteriorates the sensitivity and the frequency characteristics of the movable diaphragm. The clearances also create another problem. Sound pressure waves normally move into the housing 38 through the sound inlet ports 38*a* and cause the movable diaphragm 35 to vibrate or deflect. If the clearances are formed in the housing 38 as shown in FIG. 5, the sound pressure waves can enter the interior of the housing 38 through the clearances. This alters the directionality of the microphone and adversely affects the frequency characteristics of the microphone.

There is also a drawback to the condenser microphone 40 shown in Japanese patent application publication No. 2003-230195. The electrical connection between the bent end 44*a* of the housing 41 and the ground section 51*a* of the printed circuit board 51 may be damaged if dust or water droplets are attached thereto. If this occurs, the housing 41 and the ground section 51*a* of the printed circuit board 51 will have a resultant high electrical resistance, and the housing 41 will no longer act as an electric shield. As a consequence, electric noise (or burst noise) is free to enter the housing and significantly lowers the performance of the microphone.

It is, therefore, an object of the present invention to overcome the foregoing drawbacks and provides a reliable condenser microphone which can prevent entry of water into the interior of the microphone and also, entry of sound pressure waves into the housing of the microphone through a portion of the microphone other than predetermined sound inlet ports, and which can maintain the sensitivity, the frequency characteristics and the directionality of the microphone. It is another object of the present invention to provide a high performance condenser microphone which can exhibit a high level of electrical shielding effect.

SUMMARY OF THE INVENTION

According to one aspect of the present invention, there is provided a condenser microphone comprising a microphone unit and a housing shaped to enclose the microphone unit to mechanically protect the microphone unit, wherein the housing has a front end wall and a peripheral wall extending from the front end wall, wherein the microphone unit includes an annular retainer having a front face oriented to face against the front end wall of the housing and a rear face, a movable diaphragm having a front face, a rear face and a peripheral edge attached to the rear face of the annular retainer, the movable diaphragm being placed in confronting relation to the front end wall of the housing and deflected in response to an incident sound pressure wave through the front end wall of the housing, an annular spacer having a front face attached to the rear face of the movable diaphragm adjacent to the peripheral edge of the movable diaphragm and a rear face, a substrate connected to the rear face of the annular spacer, the substrate including a back electrode having an electret thereon and oriented in confronting relation to the movable diaphragm, and the back electrode being operatively associated with the movable diaphragm to provide a condenser having a variable electrical capacitance, and a printed circuit board connected to the substrate and including an electronic component for generating an electric signal in response to the variable electrical capacitance, and wherein the microphone unit is mounted to the housing so that the annular retainer is sealingly held against the front end wall of the housing.

As opposed to the conventional condenser microphones, the condenser microphone of the present invention can prevent entry of dust and water into the microphone unit through the rear end of the microphone which would, otherwise, deteriorate the performance of the movable diaphragm and also, substantially prevent entry of incident sound pressure waves through the rear end of the microphone.

In one embodiment, the printed circuit board includes a ground terminal, and the microphone unit further includes an electrically conductive joining member through which the annular retainer is sealingly held against the front end wall of the housing, and an electrically conducive adhesive for interconnecting the annular retainer, the movable diaphragm and the annular spacer. The annular retainer and the annular spacer are electrically conductive, and the housing is made of a metallic material and electrically connected to the ground terminal of the printed circuit board through the electrically conductive joining member, the annular retainer, the movable diaphragm and the annular spacer.

This arrangement effectively prevents entry of dust into the microphone unit.

Preferably, the electrically conductive joining member is made from an electrically conductive adhesive. It is also preferred that the front end wall of the housing includes at least one sound inlet port, and the condenser microphone further includes a water repellent dust filter attached to one side of the front end wall of the housing opposite the microphone unit and positioned to cover the sound inlet port.

According to another aspect of the present invention, there is provided a method for manufacturing a condenser microphone which comprises preparing a housing having a front end wall and a peripheral wall having a front end connected to the front end wall and an open rear end, preparing a microphone unit by stacking an annular retainer, a movable diaphragm, an annular spacer, a substrate and a printed circuit board one above the other, the substrate including a back electrode oriented in confronting relation to the movable diaphragm, having an electret thereon and operatively associated with the movable diaphragm to provide a condenser having a variable electrical capacitance, the printed circuit board including an electronic component for producing an electric signal in response to the variable electrical capacitance, and inserting the electronic unit into the housing through the open rear end of the peripheral wall of the housing while keeping said annular retainer in the front of the microphone unit and sealingly joining the annular retainer to the front end wall of the housing by a joining member.

In one embodiment, the joining member is placed on the annular retainer before the microphone unit is inserted into the housing. Preferably, the joining member is made of a thermosetting material and heated after the joining member is pressed against the front end wall of the housing.

ADVANTAGES OF THE INVENTION

As described above, the present invention is capable of preventing entry of water into the microphone and entry of sound pressure waves through a portion of the microphone other than the sound inlet ports. The present invention thus provides a reliable condenser microphone which prevents deterioration in the sensitivity and the frequency characteristics of the microphone. Also, the electrically conductive member provides a secure electrical connection between the housing and the ground of the microphone unit. The present invention thus provides a high performance condenser microphone which can effectively prevent entry of electric noise into the microphone.

DETAILED DESCRIPTION OF THE PREFERRED EMBODIMENTS

Figure 1:
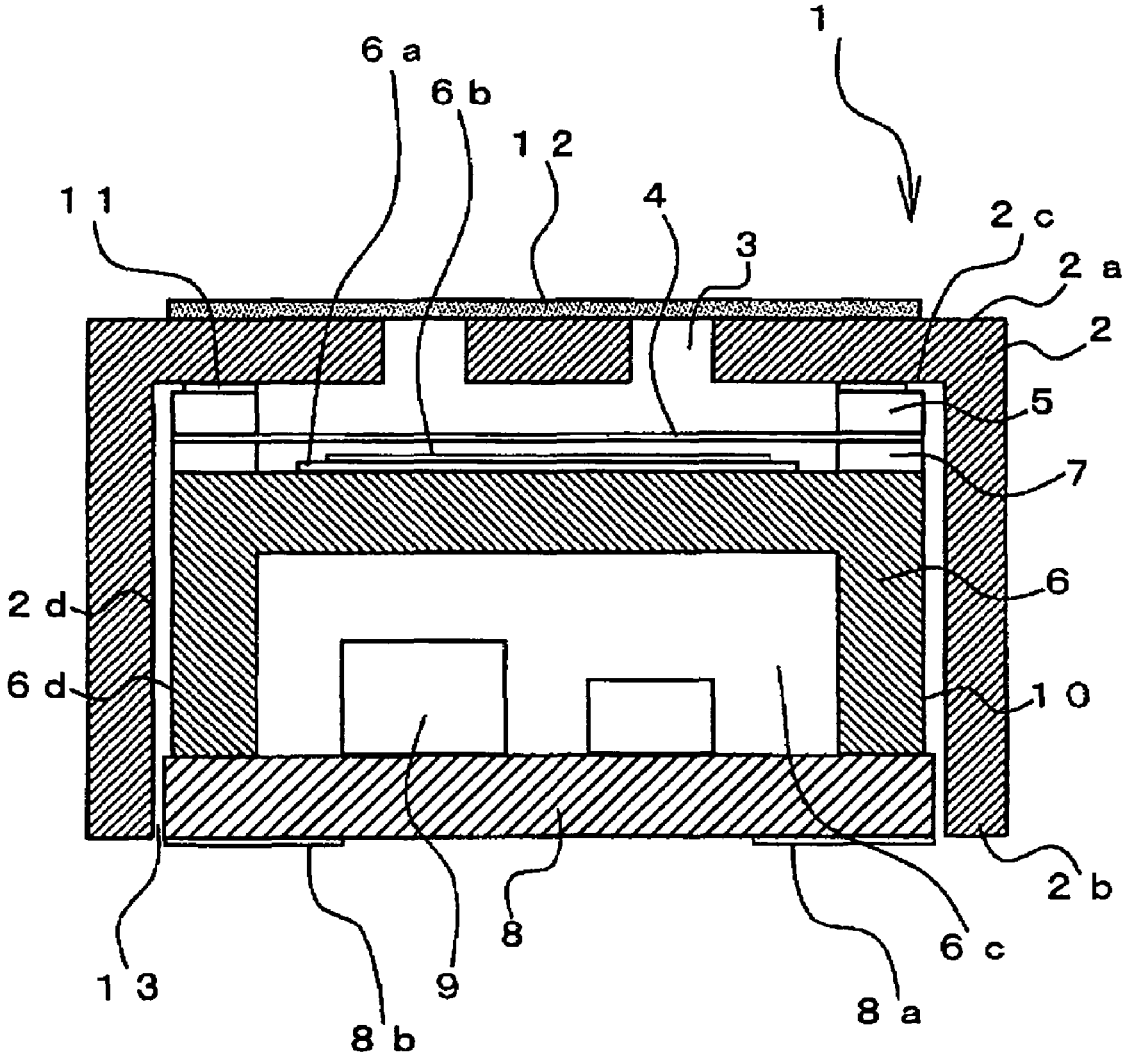
FIG. 1 is sectional view of a condenser microphone according to a preferred embodiment of the present invention.
Figure 2:
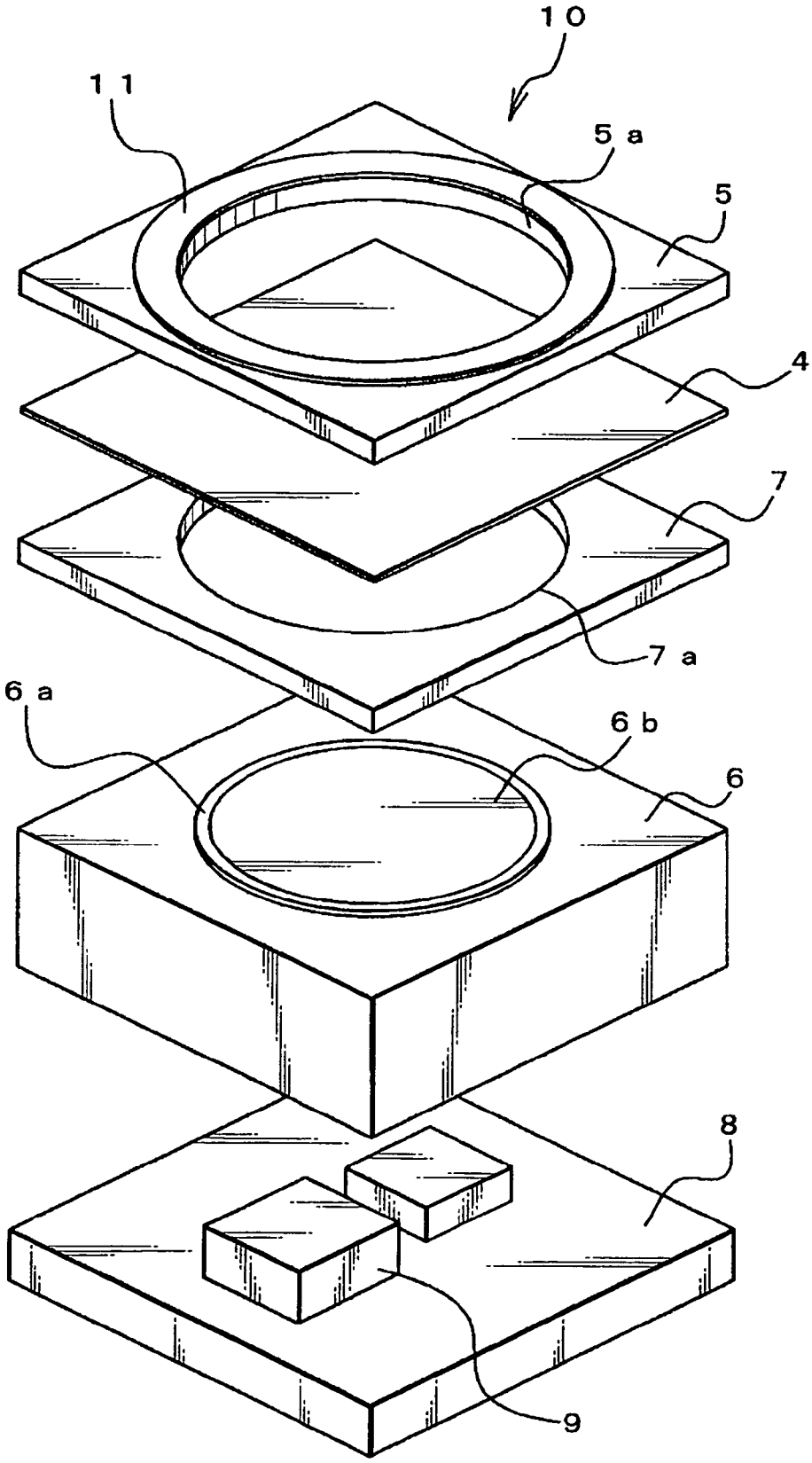
FIG. 2 is a perspective disassembled view of the microphone unit shown in FIG. 1.
Figure 3:
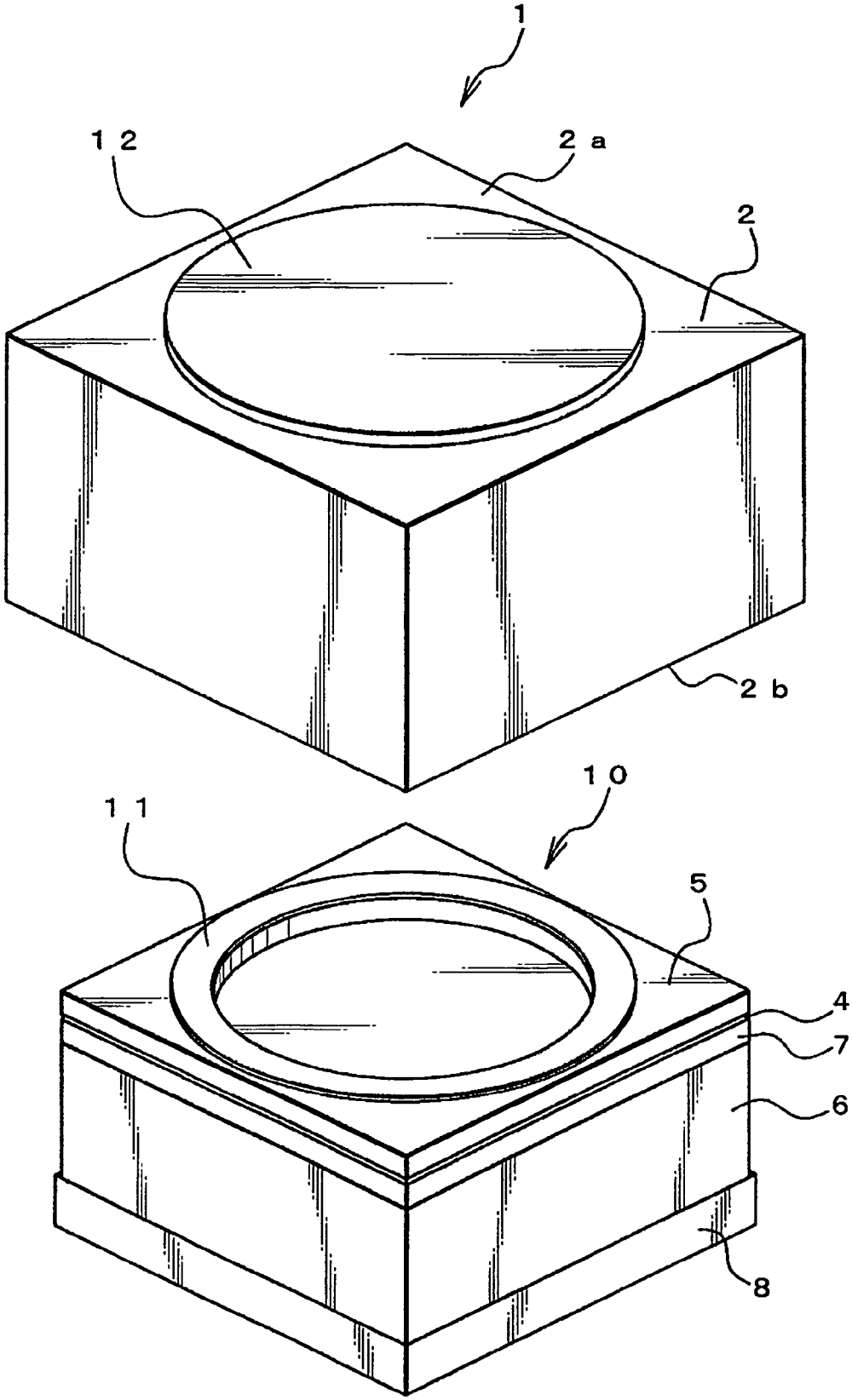
FIG. 3 is a perspective view showing the manner in which the microphone unit is assembled into a housing.
Figure 4:
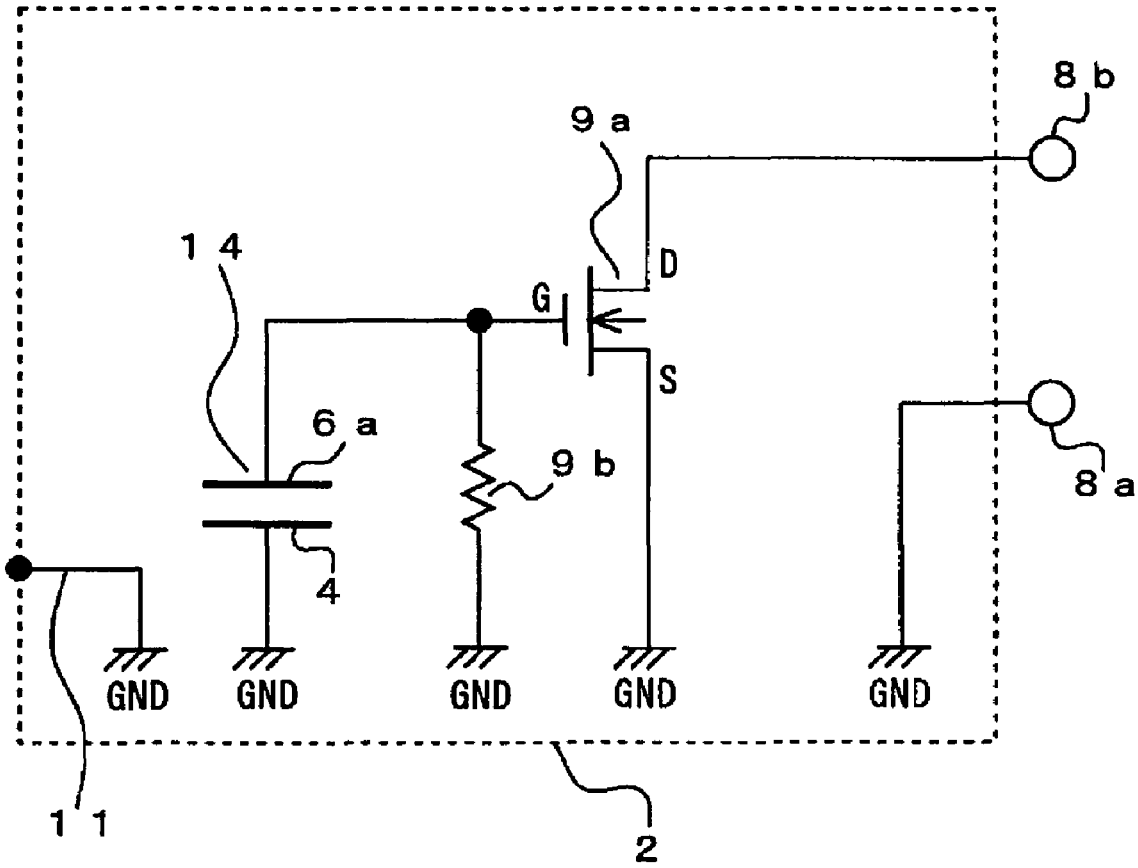
FIG. 4 is a schematic diagram showing one example of a circuitry used in the condenser microphone.
Figure 5:
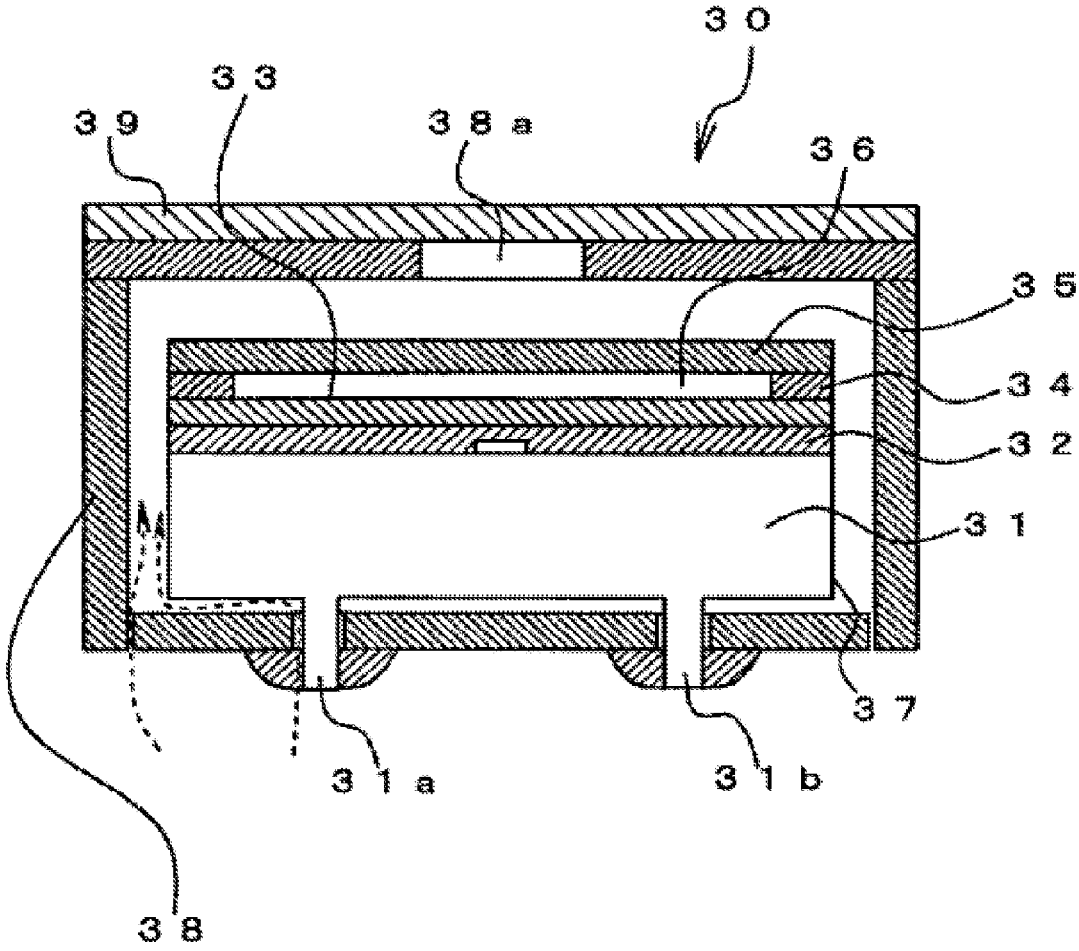
Fig. 5 (Related Art)
FIG. 5 is a sectional view of a conventional condenser microphone.
Figure 6:
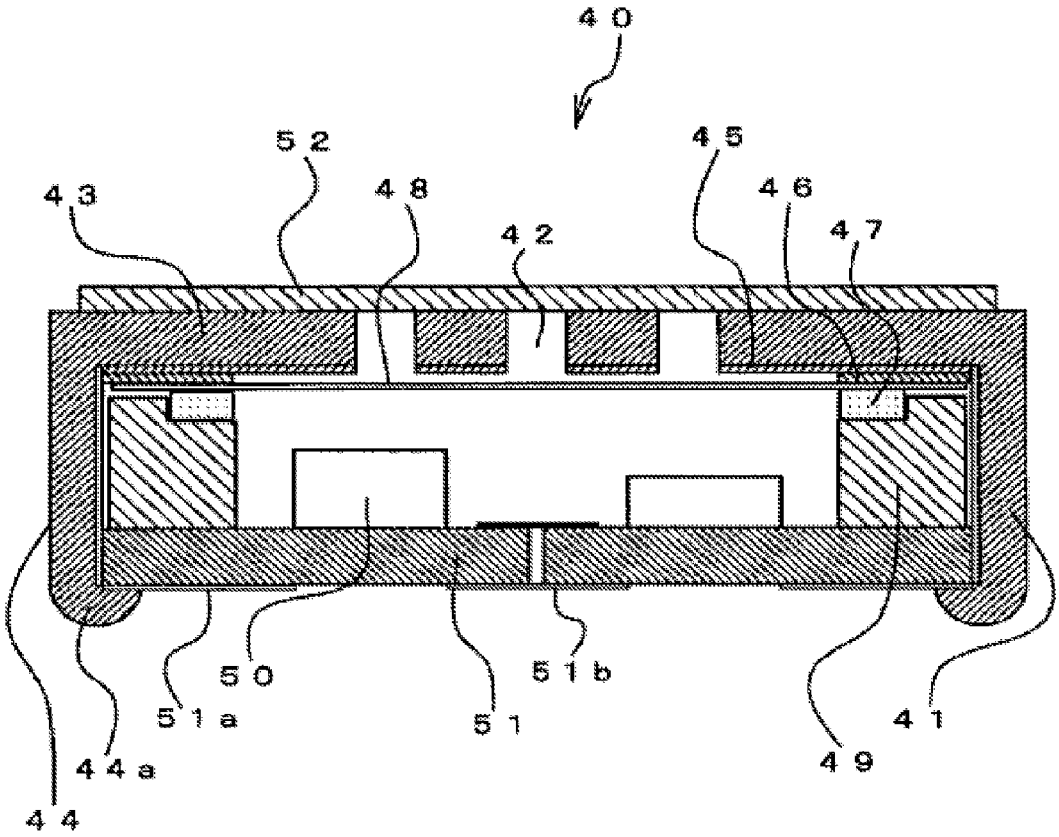
Fig. 6 (Related Art)
FIG. 6 is a sectional view of another conventional condenser microphone.

The present invention will now be described with reference to the accompanying drawings. FIG. 1 is sectional view of a condenser microphone according to a preferred embodiment of the present invention. FIG. 2 is a perspective disassembled view of the condenser microphone. FIG. 3 is a perspective view showing the manner in which a microphone unit is assembled into a housing. FIG. 4 is a schematic diagram showing one example of a circuitry used in the condenser microphone.

FIG. 1 shows a condenser microphone constructed in accordance with the present invention and generally designated as at 1. The condenser microphone 1 includes a metallic housing 2 of a generally rectangular parallelepiped shape. The housing 2 has a front end wall 2*a* and an open rear end 2*b*. A plurality of sound inlet ports 3 are defined in the front end wall 2*a* of the housing 2 to allow sound pressure waves to move into the housing 2. A microphone unit is inserted into the housing 2 through the open rear end 2*b* of the housing, as will later be described. A movable diaphragm 4 vibrates or deflects in response to an incident sound pressure wave. The movable diaphragm 4 is in the form of a thin membrane made of polyphenylene sulfide, polyethylene naphthalate, polyimide and similar resinous materials. A conductive layer is vacuum deposited on the movable diaphragm 4. A retainer 5 rests on the upper surface of the movable diaphragm 4.

A substrate 6 is made of glass epoxy and similar materials and includes a back electrode 6*a*. The back electrode 6*a* is in the form of a copper film placed on the front surface of the substrate 6. A dielectric layer or electret 6*b* is arranged on the back electrode 6*a*. A spacer 7 is arranged below the movable diaphragm 4 and extends along the outer periphery of the movable diaphragm 4. The spacer 7 cooperates with the retainer 5 to hold the movable diaphragm 4 in place. The spacer 7 separates the movable diaphragm 4 from the back electrode 6*a* by a predetermined distance. The back electrode 6*a* and the movable diaphragm 4 collectively form a condenser. The retainer 5 and the spacer 7 are preferably made of an electrically conductive material. In the illustrated embodiment, the spacer 7 and the substrate 6 are discrete members. The present invention is not limited to this embodiment. For example, the spacer 7 may be integrally formed with the substrate 6.

A printed circuit board 8 is made of glass epoxy and similar materials. A FET as an impedance converter and other electronic components 9 are surface mounted to the printed circuit board 8. Formed on the rear side of the printed circuit board 8 are a ground terminal 8*a* and an output terminal 8*b* of the electronic components 9. The ground terminal 8*a* and the output terminal 8*b* are in the form of electrically conductive layers made of copper. The electronic components 9 have a circuitry, as will later be described. The substrate 6 has a cavity 6*c* within which the electronic components 9 are located. The present invention is not limited to this arrangement. As an alternative, the substrate 6 may be in the form of a backplate, and the printed circuit board 8 may have a concave portion to receive the electronic components 9. As thus far described, the retainer 5, the movable diaphragm 4, the spacer 7, the substrate 6 and the printed circuit board 8 are stacked one above the other so as to form a microphone unit 10.

The microphone unit 10 is inserted into the interior of the housing 2 through the open rear end 2*b* of the housing 2. A conductive layer or member 11 rests on the retainer 5. The conductive member 11 is sandwiched between the retainer 5 and an inner surface 2*c* of the front end wall of the housing 2 so as to hold the microphone unit 10 in place within the housing 2. The housing 2 encloses the microphone unit 10 and serves to mechanically protect the microphone unit 10. The conductive member 11 is preferably made from a suitable material such as a conductive paste, an anisotropic conductive film and a conductive washer. A water repellent dust plate 12 is attached to the front end wall 2*a* of the housing 2 to cover the sound inlet ports 3.

As pointed out earlier, water or dust, if entered into the housing 2 possibly through the sound inlet ports 3 or a clearance 13 between the rear end 2*b* of the housing 2 and the printed circuit board 8 and then, attached to the surface of the diaphragm 4, can deteriorate the sensitivity and the frequency characteristics of the condenser microphone 1. According to the present invention, the dust plate 12 prevents entry of water or dust into the microphone unit 10 through the sound inlet ports 3. Also, the conductive member 11 prevents entry of water or dust into the housing through the clearance 13. More specifically, water and dust, after entered into the condenser microphone 1 through the clearance 13, move between an inner surface 2*d* of the side wall of the housing 2 and a side surface 6*d* of the substrate 6. The water and dust then reach between the inner surface 2*c* of the front end wall of the housing 2 and the retainer 5.

The water and dust can not, however, enter the microphone unit 10 as the conductive member 11 securely holds the retainer 5 in intimate contact with the inner surface 2*c* of the front end of the housing 2. The present invention can therefore provide a highly reliable condenser microphone. A sound pressure wave could enter the housing 2 through the clearance 13 when the condenser microphone 1 is mounted in a particular orientation within an electronic device. In such a case, the conductive member 11 effectively prevents such an incident sound pressure wave from reaching the movable diaphragm 4. The condenser microphone 1 is thus capable of preventing deterioration of its directionality and frequency characteristics regardless of the orientation of the microphone within electronic devices. Advantageously, when the retainer 5 and the spacer 7 are both made from an electrically conductive material, the housing 2 can be electrically connected to the ground terminal 8*a* of the printed circuit board 8 through the conductive member 11. In this way, the housing 2 can electrically isolate the microphone unit 10 from the outside of the housing 2. The electric shielding effect and the circuitry of the condenser microphone will later be described with reference to FIG. 4.

FIG. 2 illustrates detailed structure of the microphone unit 10 and the manner in which the microphone is assembled. As shown, the microphone unit 10 is constructed in such a manner that the retainer 5, the movable diaphragm 4, the spacer 7, the substrate 6 and the printed circuit board 8 are stacked one above the other. The retainer 5 has an opening 5*a* through which the underlying movable diaphragm 4 is exposed to the outside of the microphone unit 10. The conductive member 11 surrounds the opening 5*a* of the retainer 5 when the conductive member 11 rests on the upper surface of the retainer 5. Also, the conductive member 11 provides a tight seal between the inner surface 2*c* of the front end wall of the housing 2 and the retainer 5 when the microphone unit 1 is mounted within the housing 2. In the illustrated embodiment, the conductive member 11 is annular in shape. Alternatively, the conductive member 11 may extend over the entire surface of the retainer 5 except where the opening 5*a* is defined. In this way, the condenser microphone enjoys improved dustproof and waterproof capabilities.

The spacer 7 is located below the movable diaphragm 4 and cooperates with the retainer 5 to securely hold the movable diaphragm 4 in place. The spacer 7 has a central opening 7*a* so that the movable diaphragm 4 faces with the back electrode 6*a* of the substrate 6. The movable diaphragm and the fixed back electrodes collectively constitute a condenser. The back electrode 6*a* and the electret 6*b* are preferably circular in shape although they may take any other shapes. The printed circuit board 8 is located at the lowermost part of the microphone unit 10. The printed circuit board 8 is assembled to the substrate 6 after all the electronic components 9 are surface mounted thereto. In the illustrated embodiment, the condenser microphone unit 10 has a generally rectangular parallelepiped shape. The present invention is not limited thereto. For example, the condenser microphone unit 10 may have a cylindrical shape. It is to be understood that assembly of the microphone unit 10 requires mechanical connection as well as electrical connection. It is, therefore, preferred that an electrically conductive adhesive or a similar agent be used to stack and secure the microphone components.

FIG. 3 schematically shows the manner in which the microphone unit 10 is mounted within the housing 2. As described above, the retainer 5, the movable diaphragm 4, the spacer 7, the substrate 6 and the printed circuit board 8 collectively form the microphone unit 10. The conductive member 11 may be placed on the retainer 5 after or before assembly of the microphone unit 10 is completed.

The microphone unit 10, after completely assembled, is inserted into the housing 2 through its rear end 2*b*. It is desirable that in order to place the conductive member 11 into intimate contact with the inner surface 2*c* of the front end wall of the housing 2, a tool (not shown) be employed to apply a force in such a direction as to move the microphone unit 10 toward the front end wall of the housing 2. It is also desirable that where the conductive member 11 is made of a thermosetting material, the conductive member 11 be heated to a suitable temperature. Assembly of the condenser microphone 1 is completed when the microphone unit 10 is brought into close contact with the housing 2.

To more tightly secure the microphone unit 10 to the housing 2, the rear end 2*b* of the housing 2 may be inwardly bent. As an alternative, the clearance 13 (see FIG. 1) may be filled with a suitable molding material. It is to be noted that the dust plate 12 may be securely held against the front end wall 2*a* of the housing 2 before or after the microphone unit 10 is mounted within the housing 2.

FIG. 4 illustrates one example of the circuitry of the condenser microphone 1. A FET (Field Effect Transistor) 9*a* forms part of the electronic components 9. The FET 9*a* includes a source terminal S coupled to ground (shown as "GND" in FIG. 4) and a drain terminal D coupled to the output terminal 8*b* of the printed circuit board 8. The ground terminal 8*b* of the printed circuit board 8 is coupled to ground. The ground terminal 8*b* and the output terminal 8*b* provide microphone outputs. A resistor 9*b* forms part of the electronic components 9. The FET 9 also includes a gate terminal G. The resistor 9*b* provides an electrical connection between a gate terminal G and ground. A condenser is designated as at 14 and composed of the movable diaphragm 4 and the back electrode 6*a*. The back electrode 6*a* has a conductive layer (not show) and is coupled to the gate terminal G of the FET 9 through the conductive layer. The other electrode or movable diaphragm 4 is electrically coupled through the conductive spacer 7 and the conductive layer of the back electrode 6 to the printed circuit board 9 and also, to ground.

The retainer 5 (see FIG. 1) is tightly held against the movable diaphragm 4, as described earlier and thus, is connected to ground. As a result of this connection, the housing 2 is also connected to ground through the conductive member 11. It should be noted that the conductive member 11 not only prevents entry of water and dust into the microphone unit 10 by providing a mechanical connection between the microphone unit 10 and the housing 2, but also electrically shields the microphone unit 10 by electrically connecting the housing 2 to ground.

Operation of the microphone circuitry will now be described in detail with reference again to FIG. 4. The movable diaphragm 4 deflects when a sound pressure wave is transmitted through the sound inlet ports 3. This results in a change in electrical capacitance between the movable diaphragm 4 and the back electrode 6*a*. This capacitive change is transmitted to the gate terminal G as a change in electrical potential. The FET 9*a* amplifies the differential electrical potential and provides an electrical signal through the drain terminal D. The electrical signal is then outputted from the output terminal 8*b*. Again, the metallic housing 2 is connected to ground through the conductive member 11 so that the microphone unit 10 is electrically shielded by the housing 2. The present invention is thus capable of providing a high performance condenser microphone with improved electrical shielding effect and lower signal to noise ratio.

As thus far described, the conductive member 11 holds the microphone unit 10 in intimate contact with the inner surface 2*c* of the housing 2. This arrangement prevents entry of water and dust into the microphone unit 10 and entry of sound pressure waves into the diaphragm through portions of the housing other than the sound inlet ports. The present invention thus provides a reliable condenser microphone which prevents deterioration in the sensitivity and the frequency characteristics of the microphone and also, prohibits a change in the directionality of the microphone. The conductive member 11 also provides a secure electrical connection between the housing 2 and the ground of the microphone so that the condenser microphone 1 is electrically shielded by the housing 2. The present invention thus provides a high performance condenser microphone which prevents entry of electric noise into the microphone unit. It should be noted that the circuitry of the condenser microphone is not limited to the one shown in FIG. 4, but may take any other forms.

Although the present invention has been described in terms of specific embodiments, it is anticipated that alternations and modifications thereof will no doubt become apparent to those skilled in the art. It is therefore intended that the following claims be interpreted as covering all such alternations and modifications as fall within the true sprit and scope of the invention.

What is claimed is:

1. A condenser microphone comprising:

a microphone unit; and a housing shaped to enclose the microphone unit to mechanically protect the microphone unit, the housing having a front end wall, the microphone unit comprising:

an annular retainer having a front face oriented to face against the front end wall of the housing and a rear face;

a movable diaphragm having a front face, a rear face and a peripheral edge attached to the rear face of the annular retainer, the movable diaphragm being placed in confronting relation to the front end wall of the housing and vibrated in response to an incident sound pressure wave through the front end wall of the housing;

an annular spacer having a front face attached to the rear face of the movable diaphragm at the peripheral edge of the movable diaphragm and a rear face;

a substrate connected to the rear face of the annular spacer, the substrate including a back electrode having an electric disposed on the back electrode and oriented in confronting relation to the movable diaphragm, the back electrode being operatively associated with the movable diaphragm to constitute a condenser, the condenser having a variable electrical capacitance; and a printed circuit board connected to the substrate and including an electronic component for generating an electric signal in response to the variable electrical capacitance, the microphone unit being mounted in the housing and further comprising an electrically joining member made from an electrically conductive adhesive that sealingly connecting the front face of the annular retainer to the front end wall of the housing.

2. The condenser microphone of claim 1, wherein the printed circuit board includes a ground terminal, and electrically conducive adhesive layers for interconnecting the annular retainer, the movable diaphragm and the annular spacer, the annular retainer and the annular spacer being electrically conductive, the housing being made of a metallic material and electrically connected to the ground terminal of the printed circuit board through the electrically conductive joining member, the annular retainer, the movable diaphragm and the annular spacer.

3. The condenser microphone of claim 1, wherein the front end wall of the housing includes at least one sound inlet port, the condenser microphone further comprising a water repellent dust filter attached to one side of the front end wall of the housing opposite the microphone unit and positioned to cover the at least one sound inlet port.

4. A method for manufacturing a condenser microphone, comprising:

preparing a housing, the housing having a front end wall and a peripheral wall having a front end connected to the front end wall and an open rear end;

preparing a microphone unit by stacking an annular retainer, a movable diaphragm, an annular spacer, a substrate and a printed circuit board one above the other, the substrate including a back electrode oriented in confronting relation to the movable diaphragm and having an electret on the back electrode, the back electrode being operatively associated with the movable diaphragm to constitute a condenser having a variable electrical capacitance, the printed circuit board including an electronic component for producing an electric signal in response to the variable electrical capacitance; and inserting the microphone unit into the housing through the open rear end of the peripheral wall of the housing while keeping the annular retainer in the front of the microphone unit and sealingly joining the annular retainer to the front end wall of the housing by a joining member made from an electrically conductive adhesive.

5. The method of claim 4, wherein the joining member is placed on the annular retainer before the microphone unit is inserted into the housing.

6. The method of claim 5, wherein the joining member is made of a thermosetting material, the joining member being heated after the joining member is pressed against the front end wall of the housing.

* * * * *

UNITED STATES PATENT AND TRADEMARK OFFICE

CERTIFICATE OF CORRECTION

PATENT NO. : 7,620,191 B2
APPLICATION NO. : 11/304514
DATED : November 17, 2009
INVENTOR(S) : Haruhisa Tanabe et al.

It is certified that error appears in the above-identified patent and that said Letters Patent is hereby corrected as shown below:

On the Title Page

On the Cover Page of Letters Patent, in the first column, (75), "Fujiyoshida" should be replaced with "Fujiyoshida-shi" in both placements.

Signed and Sealed this

Ninth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,620,191 B2
APPLICATION NO. : 11/304514
DATED : November 17, 2009
INVENTOR(S) : Haruhisa Tanabe et al.

It is certified that error appears in the above-identified patent and that said Letters Patent is hereby corrected as shown below:

On the Title Page

In column 8, claim 1, lines 64-65, "electric" should be replaced with "electret".

Signed and Sealed this

Tenth Day of August, 2010

David J. Kappos

David J. Kappos
*Director of the United States Patent and Trademark Office*